United States Patent [19]

Sims et al.

[11] 4,157,826

[45] Jun. 12, 1979

[54] TOY ASSEMBLY WITH SOUND DEVICE

[75] Inventors: Anson Sims, Northridge; Lawrence T. Jones, Playa Del Rey, both of Calif.

[73] Assignee: California R & D Center, Culver City, Calif.

[21] Appl. No.: 803,667

[22] Filed: Jun. 6, 1977

[51] Int. Cl.[2] ..... A63G 17/00

[52] U.S. Cl. ..... 272/53.2; 46/99; 46/189; 272/14; 280/1.14

[58] Field of Search ..... 272/1 D, 52, 52.5, 53.1, 272/53.2, 14; 46/97, 98, 99, 111, 112, 117, 174, 175 R, 175 AR, 177, 180, 189, 190, 191, 192, 52, 63, 118; 280/1.14; 29/169.5

[56] References Cited

U.S. PATENT DOCUMENTS

| | | | |
|---|---|---|---|
| 42,960 | 5/1864 | Northrup | 272/52 |
| 1,100,833 | 6/1914 | Lapin | 272/14 |
| 2,514,510 | 7/1950 | Otreba | 46/98 |
| 2,679,126 | 5/1954 | Doe et al. | 46/98 X |
| 2,740,636 | 4/1956 | Dix | 280/1.14 |
| 2,751,710 | 6/1956 | Pace | 46/175 R |
| 2,968,863 | 1/1961 | Johnson | 29/169.5 |
| 2,992,511 | 7/1961 | Crawford | 46/177 X |
| 3,010,252 | 11/1961 | Crawford et al. | 46/111 X |
| 3,055,672 | 9/1962 | Parks | 280/1.14 |
| 3,090,618 | 5/1963 | Brent | 272/53.2 |
| 3,139,476 | 6/1964 | Alvarez | 29/169.5 X |
| 3,169,764 | 2/1965 | Royce | 272/1 D |
| 3,201,117 | 8/1965 | Gursha | 272/1 D |

*Primary Examiner*—Richard C. Pinkham
*Assistant Examiner*—Arnold W. Kramer
*Attorney, Agent, or Firm*—Harold L. Jackson; Stanley R. Jones; Joseph W. Price

[57] ABSTRACT

The present invention provides a sound producing device that can be combined with a toy hobby horse. A whinny or neigh sound can be produced by child operated movement of reins to stress and subsequently release a weight loaded spring lever. A coil spring is positioned to contact the spring lever for the generation of the noise. A one-way stop mechanism can retain the weighted spring lever until it is placed under sufficient stress by the operator to effectuate its release.

10 Claims, 3 Drawing Figures

TOY ASSEMBLY WITH SOUND DEVICE

BACKGROUND OF THE INVENTION

1. Field of the Invention

The present invention is directed to the toy industry and more particularly to an improved hobby horse with an audio generating device.

2. Brief Description of the Prior Art

Rocking horse toys have been known in the prior art for a considerable period of time. The recent commercial rocking horse toys have been spring suspended on an adjustable square or X-shaped tubular frame. One commercial version of a rocking horse incorporates a saddle blanket music box that is powered by a DC battery to provide carnival music.

A large number of sound producing or voice unit devices are presently known in the toy industry and are relatively sophisticated, such as U.S. Pat. No. 4,101,959. These devices are generally capable of reproducing sounds from record mediums.

To date, the prior art has not provided a relatively efficient and economical audio generating device that simulates the sound of a horse and is capable of being combined in a hobby horse toy.

SUMMARY OF THE INVENTION

The present invention provides an audio generating assembly for use in toys and includes a biased resilient lever member that is mounted for repetitive sliding movement with a relatively stationary member to produce an audible frequency decaying sound characteristic of a horse. The audio generating assembly can be mounted in the head of a hobby horse toy and can be actuated through a simulated mounting bit with reins attached. When the child pulls the reins the weighted resilient member can be prestressed prior to a sudden impact sliding movement with a stationary member. Means are provided to restrain the resilient member until a sufficient torque force is produced to actuate a sound producing cycle of movement.

The objects and features of the present invention which are believed to be novel are set forth with particularity in the appended claims. The present invention, both as to its organization and advantages thereof, may best be understood by reference to the following description, taken in connection with the accompanying drawings.

DESCRIPTION OF THE PREFERRED EMBODIMENT

The following description is provided to enable any person skilled in the toy industry to make and use the invention and it sets forth the best mode contemplated by the inventors in carrying out their invention. Various modifications, however, will remain readily apparent to those skilled in the above art, since the generic principles of the present invention have been defined herein specifically to provide a relatively economical and easily manufactured audio generating assembly for use with a rocking horse toy.

Figure 1:
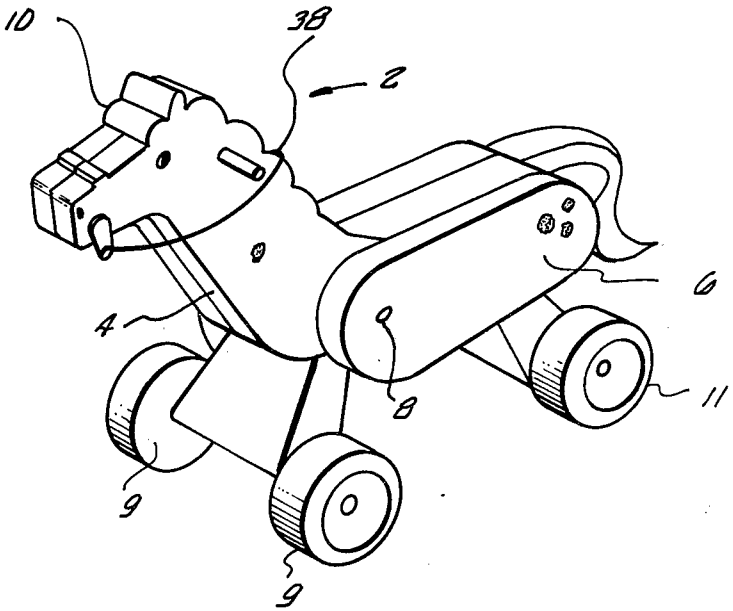
FIG. 1 is a perspective view of a hobby horse assembly of the present invention.

Referring to FIG. 1, a rocking or hobby horse toy 2 is disclosed in a schematic perspective view. Basically, the hobby horse assembly comprises two relatively movable parts. The first body part 4 includes a simulated head 10 and forefeet of a horse while the second body part 6 includes the simulated back and hind legs of a horse. The first and second body parts are supported by wheels 9 and 11 and are connected together by an appropriate hinge 8 to permit relative vertical movement as desired by a child operator. The individual body parts can be molded from a styrene plastic compound as known in the prior art and can be molded as half shells which are joined together by appropriate fasteners not shown.

Figure 2:
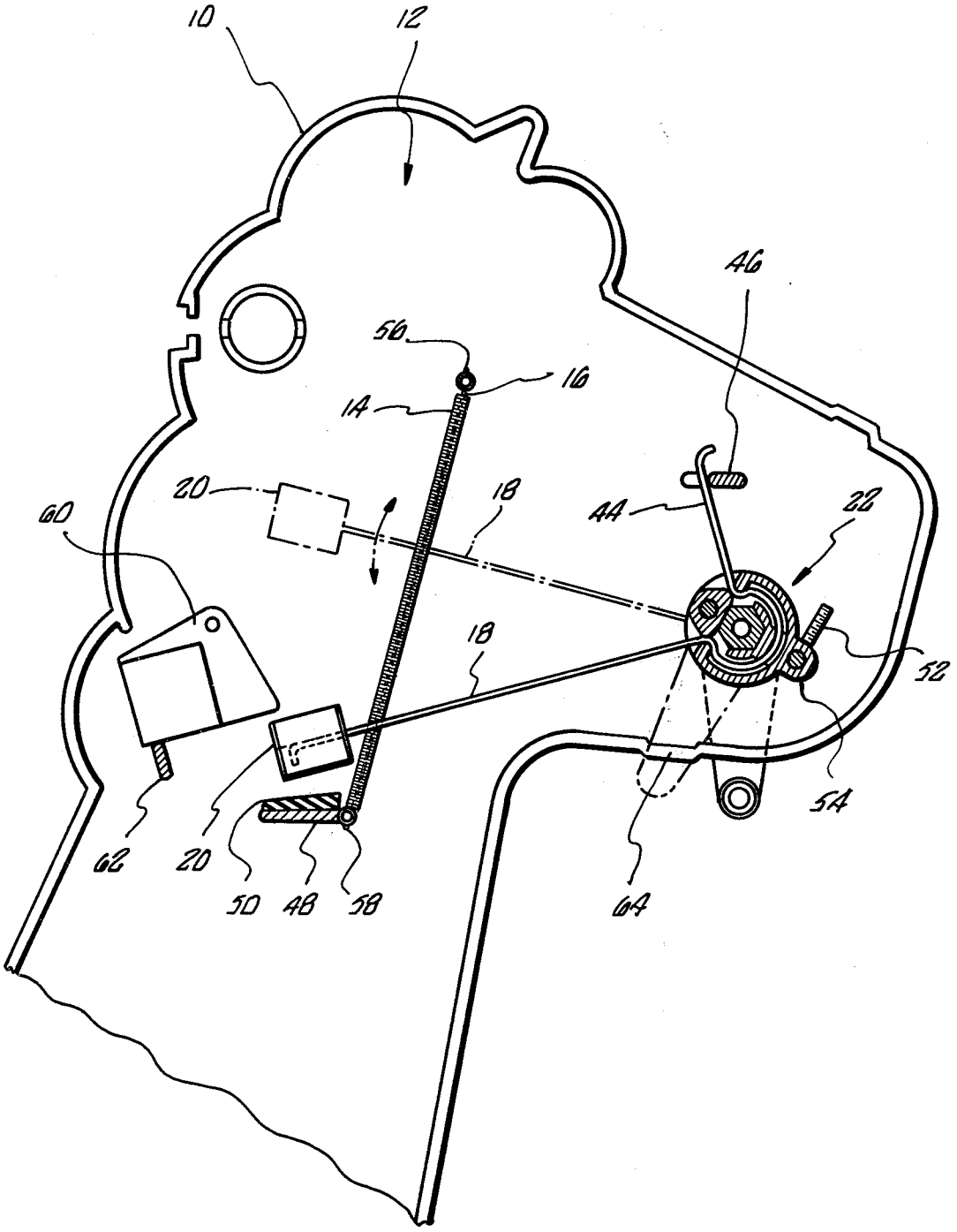
FIG. 2 is a cross-sectional view of a hobby horse head incorporating an audio generating assembly.

Referring to FIG. 2, a cross-sectional view of the horse head 10, is disclosed with a mounted audio generating assembly 12. The audio generating assembly includes basically a tightly wound coil spring 14 that can be freely mounted on a taut music wire guide 16. A resilient lever or striker member 18 formed also from music wire is cantilevered or suspended from a pivotal mounting means for oscillating movement to produce a decaying frequency sound. A weight member 20, is attached to one end of the striker member 18.

Figure 3:
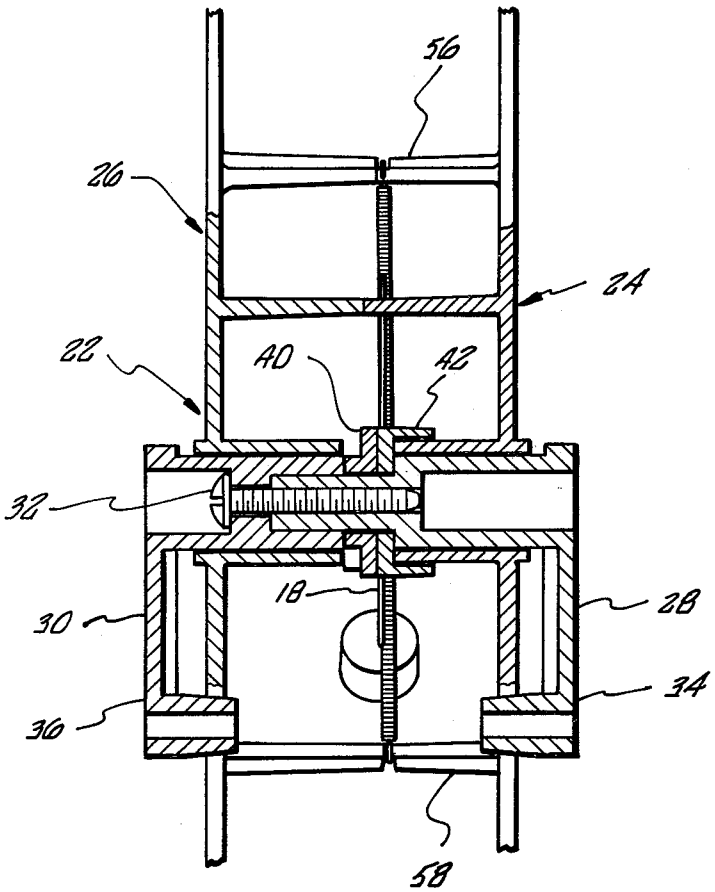
FIG. 3 is a cross-sectional view of the mounting of the resilient member of the audio generating assembly.

The pivotal mounting means that is provided for the striker member 18 includes a crush boss assembly 22. By referring to a cross-sectional view in FIG. 3, it can be seen that the crush boss assembly 22 includes a housing formed by the respective half shells 24 and 26 that comprise the simulated head 10 of the horse 2. Mounted within the cylindrically shaped housing of the boss assembly, are a pair of simulated bits 28 and 30 that are attached together by a fastener 32. Respective lever arm bits 34 and 36 provide both a connection for reins 38 and create a moment arm to permit a child operator to exert a force on the striker member 18 by the relative rotation of the lever arm bits. Retainer washers 40 and 42 assist in capturing the oscillator or striker member 18.

As can be seen from FIG. 2, the music wire spring that forms the oscillator striker member 18 can be extended to pass through and out of crush boss assembly 22 at a 90° angle to the relaxed plane of the striker member 18. This spring tail member 44 can be mounted under tension on a retainer bar 46 to provide an optional return force on the striker member 18. The weighted member 20, however creates a torque force on the crush boss assembly 22 by virtue of the pull of gravity and accordingly, biases the striker member 18 toward a rest position on a stop member 48 when the reins 38 are released.

A rubber shock absorber or pad 50 can optionally be provided on the stop member 48 to dampen any impact sound. The stop member 48 like the other appendages can be injection molded intricately with the half shells. An additional stop member 52 can be molded to contact an ear member 54 extending from the crush boss assembly 22 and thereby limit its rotational movement.

A pair of rib and pin assemblies 56 and 58 can also be molded to extend from the respective half shells forming the horse head 10 for mounting the music wire guide 16. In an alternative embodiment, the coil spring 14 can be mounted directly on the rib and pin assemblies 56 to eliminate the wire guide 16.

Means to restrain the pivotally mounted striker member 18 include a pivotally mounted cam lever block 60 which is shown in its rest position adjacent the stop member 62 in FIG. 2. An edge of the cam lever block 60 is designed to cam or coact against the upper surface of the weighted member 20 to restrain its release until the striker member 18 is sufficiently bent.

The exterior of a simulated chin portion of the horse head 10 further defines a stop 64 to limit the relative movement of the bits 28 and 30. The stop 64 is angularly disposed about the rotational path of the respective bits to cause the striker member 18 to have a rest or center datum position at roughly the center of the coil spring 14 when the respective bits 28 and 30 are held against the stop member 64. This stop 64 defines the gravity and frictional clamped oscillational movement of the striker member 18. The sound produced simulates the whinny or neigh sound characteristic of a horse.

This generated sound incorporates a decaying frequency that is proportional to the oscillational movement of the striker member 18 against the coil spring 14. It has been found the the oscillator striker memeber is preferably made from music wire having an outside diameter of 0.045 inches. This same music wire can also be used as the guide spring support 16 for mounting the coil spring 14. The weighted member 20 is positioned approximately three and one-half inches on the striker member 18 from the crush boss assembly 22. The preferred weighted member 20 weighs one ounce. Satisfactory results, however, have been obtained with a 0.041 outside diameter music wire having a three-quarter ounce weight and a 0.037 inch outside diameter music wire having a one-half ounce weight. The experimental ratio of the striker member 18 outside diameter to weight ratio is 0.016 inch per ounce for the operative weight range.

The coil spring 14 is freely mounted on the guide wire support 16 and occupies most of the area between the rib and pin assemblies 56 and 58. In the preferred embodiment the coil spring 14 has a length of 4.1 inches with an outside coil diameter of 0.125 inches. The wire outside diameter is 0.016 inches and the spring rate, k, is 0.267 pounds per inch. The coils on the spring are closed and have an initial closing compressive force of 0.13 pounds.

It is possible to vary some of these parameters and in fact, experiments were tried with various size coils and wires. It was discovered that as the coil spring wire outside diameter was increased, e.g., to 0.032 inches, the frequency became less and the dampening became greater, thus effecting the oscillating decaying whinnying sound produced. The use of a significantly smaller outside diameter wire tended to produce a scraping or a rasping sound that deviated from the simulated horse whinny or neigh. The specification for the particular striker member 18 and coil spring 14 set forth herein are the best mode of the invention and the closest approximation of an actual horse sound. It should be appreciated, however, that variances from these dimensions would be possible to produce a competitive device and accordingly the scope of the present invention should not be specifically limited to these dimensions.

In operation, the child operator can simulate the movement of an actual horse by the relative displacement and impact of his own body weight causing a relative movement between the first body member 4 and the second body member 6. As can be appreciated, it is alternatively possible to use this movement as the means to activate the horse like sound if the resilient striker member is modified to have a free cantilevered position to provide an oscillating movement against the contact coil spring member. Thus, it is not necessary to utilize the reins 38 as the means on the body housing to actuate the horse sound. As can be readily appreciated by a person skilled in the art, the resilient music wire lever 18 can be free standing or can cooperate with some other actuation means that can be responsive to simply the relative movement of the first body part 4 and the second body part 6 or even the simple movement of either body member by itself.

The striker member 18 is biased against the coil spring 14 so that positionally it would extend 0.05 inches beyond the coil spring 14 position if the coil spring 14 was removed from the body housing. In operation, the child operator can generate the simulated horse whinnying or neigh sound by pulling on the reins 38. The rearward movement of the reins 38 rotate the simulated bits 28 and 30 and accordingly attempt to rotate the striker member 18 by the same angular amount. The edge of the cam lever block 60, however, interfaces with the top surface of the weight 20 and initially restrains that end of the striker member 18. During the rotation, sufficient stress is placed on the striker member 18 to bend its music wire and to cause the weighted member 20 to slide in a follower motion beyond the cam 60 to permit a sudden release of the stressed striker member 18. The bit lever arms 34 and 36 coact with the stop member 64 to provide a cantilevered datum position of the striker member 18 at approximately the mid section of the coil spring 14.

Because the striker member 18 had been put under tension to create a spring force which is released when the lever bits 36 and 38 are rotated a predetermined number of degrees, the sudden release of force accelerates the weighted member 20 upward until it is overcome by gravity to again fall. This causes an oscillating movement about the datum line established by holding the reins 38 tight to in turn position the bit lever arms against the stop member 64. The sliding contact between the striker member 18 and the coil spring 14 produces a decaying frequency whinnying sound or neighing sound that simulates a real horse. The actual sound pattern starts with a higher pitched frequency and diminishes to the lower pitched frequency that is characteristic of a horse sound.

Releasing the reins 38 permits the striker member 18 to return to rest against the stop member 48. This can be accomplished as a result of simply the gravitational pull and moment arm created by the weight 20 and the lever arm 18 suspended from the crush boss assembly 22. Alternatively, the optional spring tail member 44 can further rotationally bias the crush boss assembly 22 to return the striker member 18.

As the striker member approaches the stop member 48 to assume its rest position, it contacts the exterior surface of the cam lever block 60 and pivots it clear of the travel path of the weight member 20. The cam lever block 60 is appropriately pivotally mounted and weighted to reassume its position shown in FIG. 2, after the lever member 18 has passed. Rubber pad 50 absorbs any returning impact force and prevents any artificial sounding impact noise against the stop member 48. Once the striker member 18 has cleared the cam lever block 60, the audio generating assembly 12 is essentially operative again to be actuated by a child operator in pulling the reins 38. Thus, repetitive whinnying or neighing sounds can be produced at the option and pleasure of the child.

As mentioned earlier, the preferred embodiment is disclosed herein but variations from the specific specification and dimensions are possible by a person skilled in this field and accordingly the scope and spirit of the present invention should be determined solely from the following claims wherein we claim.

What is claimed is:

1. A hobby horse toy assembly having audio capability to produce sounds simulating a horse comprising;
   - a body housing simulating the configuration of a horse;
   - a resilient metallic striker member pivotally mounted within the body housing;
   - a weighted member attached to one end of the striker member;
   - a coil spring mounted within the body member between the weighted member and the pivotal mounting so as to be biased into contact with the resilient striker member;
   - means for restraining the striker member until sufficient stress is generated to effectuate a sudden release sliding movement between the striker member and the coil spring, and
   - means for activating the striker member.

2. The invention of claim 1 wherein the coil spring is pretensioned to a closed configuration with an outside diameter of approximately 0.125 inch and a wire diameter of approximately 0.016 inch and the striker member is music wire having an outside diameter ratio to the weight of the weighted member of approximately 0.016 inch per ounce across an operative range of weights and a suspended length of approximately 4 inches.

3. A noise making apparatus for producing a simulated neighing sound of a horse, the apparatus comprising:
   - a mounting base;
   - a coil spring fixedly attached to the mounting base between at least two points, an intermediate portion of the coil spring being disposed between the two points of attachment;
   - a resilient lever pivotally mounted at one portion to the mounting base about an axis of rotation, and having a free end extending beyond the intermediate portion of the coil spring, the resilient lever providing a contact surface for sliding across the surface of the coil spring, the pivotal point of the lever and the contact surface defining a plane perpendicular to the axis of rotation whereby the lever and the coil spring are relatively biased to provide a sliding contact throughout the pivotal movement to produce a neighing sound simulating a horse;
   - a weight attached to the free end of the lever, and
   - actuating means for pivoting the lever.

4. The invention of claim 3 wherein the actuating means include at least one rein.

5. The invention of claim 3 wherein the resilient lever is a music wire lever.

6. The invention of claim 3 further including a rotatable shaft attached at one end to the resilient lever, the means being operatively attached to the shaft.

7. A toy hobby horse capable of producing a simulated whinny sound comprising:
   - a body housing simulating the configuration of a horse;
   - a coil spring mounted at least on two points within the housing;
   - a resilient lever mounted within the housing for a pivoting motion and disposed to stay in contact with the coil spring, the pivoting motion of the lever occurring in a plane which is substantially parallel with the coil spring, a portion of the lever extending beyond the coil spring;
   - a weight attached to the extending portion of the lever, and
   - means for pivoting the lever to cause an oscillation of the lever about an axis of rotation perpendicular to the plane of the lever whereby the lever rubs against the coil spring and produces a whinny sound.

8. The invention of claim 7 further comprising a central member mounted within the housing, the coil spring being mounted on the central member.

9. The invention of claim 7 wherein the means include a rotatable shaft, and wherein the lever is a wire and the weight is attached to one end of the wire, the other end of the wire being attached to the rotatable shaft.

10. The invention of claim 9 wherein the means for pivoting further includes at least one rein connected to the shaft and capable of being pulled by an operator.

* * * * *